US010326220B1

(12) United States Patent
Most et al.

(10) Patent No.: US 10,326,220 B1
(45) Date of Patent: Jun. 18, 2019

(54) MAGNETICALLY ATTACHED ELECTRICAL CONNECTION FOR A PORTABLE DEVICE

(71) Applicants: Matthew Isaac Most, Boulder, CO (US); Trevor Glen Vita, Boulder, CO (US)

(72) Inventors: Matthew Isaac Most, Boulder, CO (US); Trevor Glen Vita, Boulder, CO (US)

( * ) Notice: Subject to any disclaimer, the term of this patent is extended or adjusted under 35 U.S.C. 154(b) by 477 days.

(21) Appl. No.: 15/289,469

(22) Filed: Oct. 10, 2016

Related U.S. Application Data

(63) Continuation-in-part of application No. 14/959,976, filed on Dec. 4, 2015.

(60) Provisional application No. 62/088,048, filed on Dec. 5, 2014.

(51) Int. Cl.

| | |
|---|---|
| ***H01R 11/30*** | (2006.01) |
| ***H01H 3/12*** | (2006.01) |
| ***H01F 7/02*** | (2006.01) |
| ***H01R 24/38*** | (2011.01) |
| ***A24F 47/00*** | (2006.01) |
| *H01R 103/00* | (2006.01) |

(52) U.S. Cl.
CPC ..... *H01R 11/30* (2013.01); *A24F 47/008* (2013.01); *H01F 7/0252* (2013.01); *H01H 3/12* (2013.01); *H01R 24/38* (2013.01); *H01R 2103/00* (2013.01)

(58) Field of Classification Search
CPC .. H01R 13/501; H01R 13/72; H01R 31/2421; H01R 13/6205; H01R 11/30; H01R 24/30; H01R 25/00; H01R 31/005; H01R 31/065; H01R 2201/06
USPC ..... 392/394
See application file for complete search history.

(56) References Cited

U.S. PATENT DOCUMENTS

| | | | | |
|---|---|---|---|---|
| 7,625,213 | B1 * | 12/2009 | Tse | H01R 13/6205 439/22 |
| 2016/0013582 | A1 * | 1/2016 | Byrne | H01R 13/2421 439/39 |
| 2017/0223440 | A1 * | 8/2017 | Rodrigues | H04R 3/12 |

* cited by examiner

*Primary Examiner* — Brian W Jennison
(74) *Attorney, Agent, or Firm* — Marsh Fischmann & Breyfogle LLP; Russell T. Manning

(57) ABSTRACT

Presented is an electrical connection mechanism designed to attach magnetically to a portable electronic device. The mechanism is designed specifically for a cylindrical device which incorporates a pushbutton switch. Battery-operated flashlights, laser-pointers and active styli are devices well suited for use with this device. In one embodiment, the device is a portable herbal vaporizer.

7 Claims, 19 Drawing Sheets

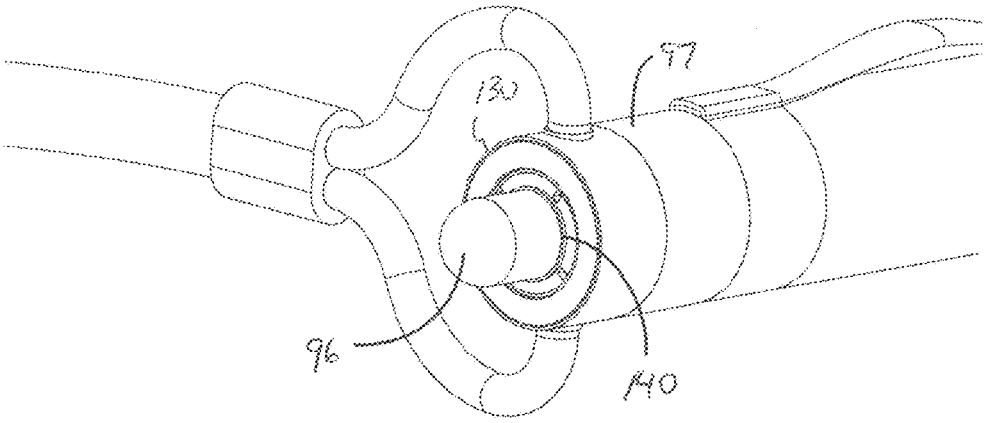
Fig 2.B

MAGNETICALLY ATTACHED ELECTRICAL CONNECTION FOR A PORTABLE DEVICE

CROSS-REFERENCE

The current application is a continuation-in-part of U.S. patent application Ser. No. 14/959,976 filed on Dec. 4, 2015 and which claims the benefit of the filing date of U.S. Provisional Application No. 62/088,048 having a filing date of Dec. 5, 2014, the entire contents of both of which are incorporated herein by reference.

FIELD

The present disclosure relates generally to electrical interconnects. More specifically, the present disclosure relates to electrical interconnects for portable electronic devices that allow for recharging and or/directly powering the device.

BACKGROUND

Portable electronic devices which contain embedded batteries and which require large amounts of electrical energy typically require frequent recharging. This is especially evident in devices that are specifically designed to be compact, which reduces the size available for battery storage.

One example of high power compact portable electronic devices are vaporizers. Portable vaporizers are currently utilized to extract the active ingredients of herbs for inhalation. Users of such vaporizers often prefer the devices to be extremely compact. In this regard, users tend to prefer vaporizers having small form factors similar in size to pens or electronic cigarettes. However, due to the high temperatures required to vaporize herbs, significant amounts of electrical power are required. Along these lines, some prior art battery powered vaporizers are effective for only a small number of uses per charge.

To provide continued use, such devices sometimes feature external electrical connections to allow for battery charging and/or device operation from an external power source.

SUMMARY

The present inventors have recognized that electronic devices with narrow cylindrical form-factors have space and geometrical constraints that drastically limit design flexibility with regards to providing an electrical interface. The presented inventions solve this problem through use of a unique magnetic attachment mechanism.

The presented inventions are directed to electrical connection mechanisms for battery operated devices. In one non-limiting arrangement, the device is a portable herbal vaporizer that has the outward appearance of a common ink pen. However, the invention directly applies to any electronic device which is cylindrical, incorporates a pushbutton switch, and requires a means for attachment with an external electrical connection.

In one aspect, an electrical connection mechanism is provided that is a sleeve assembly having an aperture and at least two partially concentric terminals. The aperture of the assembly is configured for disposition about a depressible switch or actuator of the device and is maintained in contact with a surface of the device by means of a magnet. Such a magnet may be located in the sleeve assembly or in the device. In any arrangement, the magnet couples to a ferromagnetic surface. The sleeve assembly contains two electrically isolated terminals and, when attached about the actuator of the device, one of the terminals is electrically connected to the push button or actuator while the other terminal is electrically connected to a surface about the base of the push button or actuator. In this regard, two electrical connections may be provided through an end surface of a device having a narrow cylindrical form-factor with space and geometrical constraints.

In one arrangement, the assembly includes an inner sleeve and an outer sleeve. In such an arrangement, the inner sleeve generally defines the aperture that is configured to fit about the actuator. The inner sleeve is at least partially received within an interior of the outer sleeve such that these elements are at least partially concentric. In one arrangement, the aperture of the inner sleeve is oblong and/or non-aligned with a centerline axis of the actuator. Such an arrangement allows for tilting of the connection mechanism relative to the device thereby facilitating its removal.

Various electrical isolators may be disposed between the sleeves. Such electrical isolators may be individual components. In another arrangement, the electrical isolators may be a resin (e.g., thermoplastic, etc.) that is injected into the assembly during manufacture.

BRIEF DESCRIPTION OF THE DRAWINGS

FIG. 2B illustrates the electrical connection mechanism connected to a portable electronic device.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

The present disclosure is directed to an electrical connection mechanism for a battery operated device. In one specific embodiment, the electrical connection mechanism is utilized with a portable herbal vaporizer that has the outward appearance of a common ink pen. However, the invention directly applies to any electronic device which is cylindrical, incorporates a pushbutton switch, and requires a means of attachment to an external electrical connection. Rechargeable flashlights, laser-pointers, or active styli are product examples to which this invention is well-suited. For purposes of the present disclosure, a portable electronic device is initially discussed followed by a discussion of the connection mechanism as configured for use with the portable electronic device.

Portable Electronic Device

Figure 1A:
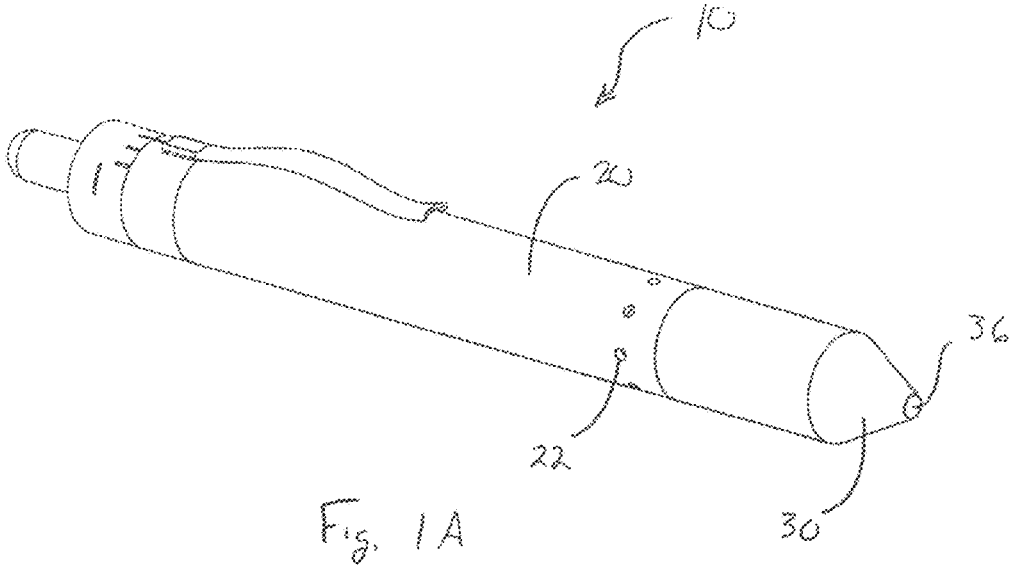
FIG. 1A is a perspective view of one embodiment of a vaporizer.

FIG. 1A illustrates a perspective of a portable vaporizer 10 for extracting active ingredients of herbs for inhalation. The vaporizer 10 is similar in size and form to a fountain pen. As shown, the vaporizer 10 includes a cylindrical body 20 and a mouthpiece 30. The mouthpiece 30 tapers to an opening 36 that a user utilizes to draw air into the vaporizer via air inlet apertures 22 in the cylindrical body 10. More specifically, the air is drawn through the interior of the vaporizer 10 where it passes through an internal heating element/heating exchanger, which heats the air to a desired temperature. The heated air passes through an internal herb chamber which holds a supply of herbs, which may be at least partially vaporized. The user draws the resulting vapor through the opening 36 in the mouthpiece.

Figure 1B:
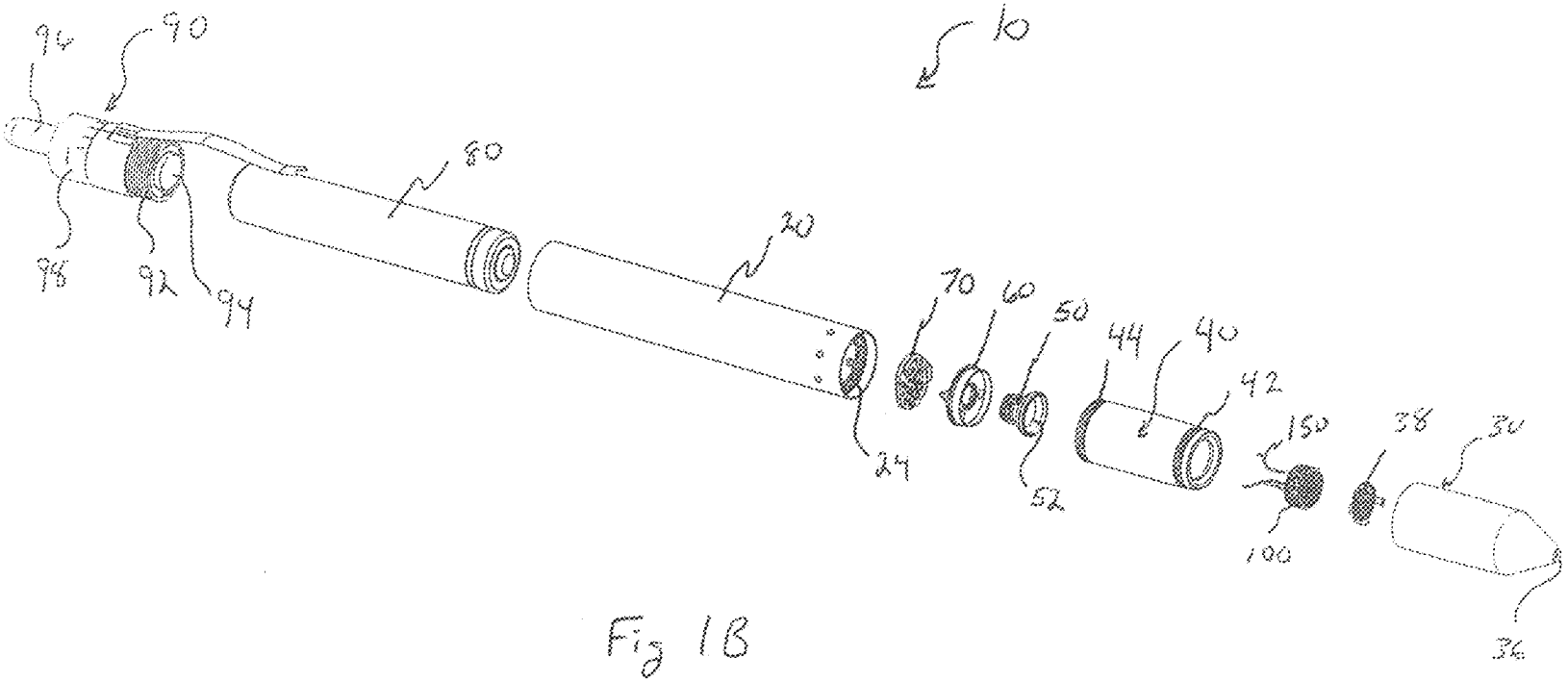
FIG. 1B is an exploded perspective view of the vaporizer of FIG. 1A.
Figure 1C:
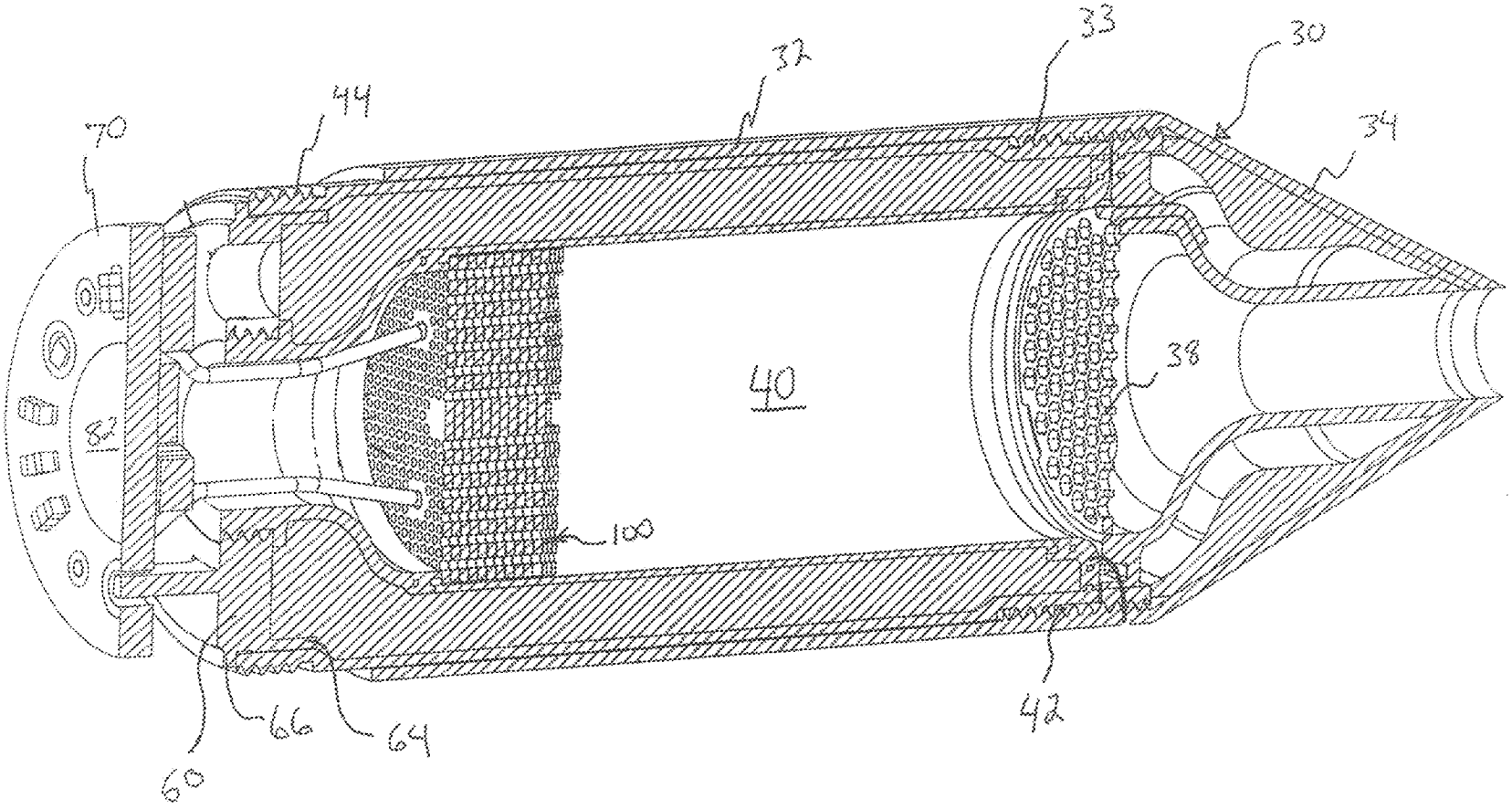
FIG. 1C is cross-sectional perspective view of a forward portion of the vaporizer of FIG. 1A.

FIG. 1B illustrates an exploded perspective view of the vaporizer 10 and FIG. 1C illustrates a cross-sectional view of an assembled forward portion of the vaporizer 10. As shown, the mouthpiece 30 is formed of a generally hollow cylindrical section 32 attached to a conical end section 34. The mouthpiece 30 includes internal threads 33 located near the transition between the cylindrical section 32 and the conical end section 34 as best shown in FIG. 1C. These internal threads 33 engage external threads 42 located on the forward end of a generally hollow herb chamber 40. External threads 44 on a rearward end of the herb chamber attach to internal threads 24 on a forward end of the cylindrical body 20. See FIG. 1B. In the present embodiment, when the mouthpiece 30 is in threaded engagement with the herb chamber 40, the cylindrical section 32 of the mouthpiece 30 extends over the herb chamber 40 and abuts with the forward end of the cylindrical body 10. See FIG. 1A.

Referring again to FIGS. 1B and 1C, a rearward interior portion of the herb chamber 40 houses a heating element 100, when the vaporizer 10 is assembled. A forward portion of the herb chamber 40 (i.e., in front of the heating element) provides an open internal space for placement of herbs. The heating element 100 is a convective heating element which heats air drawn into the herb chamber 40 from the air inlet apertures 22 in the cylindrical body. As illustrated, a screen 38 may be disposed within the mouthpiece 30 to prevent any particulate from passing through the device. In a further embodiment another screen (not shown) may be disposed within the herb chamber 40 proximate to the heating element 100.

An air nozzle 50 is positioned against a rearward end of the heating element 100 as best shown in FIG. 1C. The nozzle 50 extends from a small inlet aperture 51 (See FIG. 1C) to a larger exit aperture 52 (see FIG. 1B), juxtaposed against the rearward end of the heating element 100 to fluidly connect the inlet apertures 22 to the heating element 100, when the herb chamber 40 is in threaded connection with the cylindrical body 20. In the present embedment, external threads 54 on a rearward end of the air nozzle 52 connect with internal threads of a mount 60 having a flange 64 received within the rearward end of the herb chamber 40. When assembled, the herb chamber 40 compresses a rim 66 of the mount 60 against the bottom of the internal threads 24 of the forward end of the cylindrical body 10. A rearward surface of the mount 60 supports a forward electronics control circuit or forward circuit board 70. Connecting wires 102 (e.g., power wires, sensor wires etc.) of the heating element 100 pass through the air nozzle 50 for connection with the forward circuit board 70. Other connections are possible.

The cylindrical body 20 houses a battery 80 in its rearward portion behind the air inlet apertures 22. See FIG. 1B. An end cap assembly 90 having external threads 92 engages internal threads (not shown) on a rearward portion of the cylindrical body 20. When the end cap assembly 90 is in threaded engagement with the cylindrical body 20, a forward terminal of the battery 80 engages a first electrical contact 82 of the forward circuit board 70 and a second contact 94 of the end cap assembly 90 engages a rearward terminal of the battery 80. The end cap assembly 90 includes a depressible power button 96 that allows for activating and deactivating the device 10 (i.e., completing an electrical circuit). Additionally, the end cap assembly 90 further includes a temperature adjustment dial 98, which allows for adjusting the temperature of air passing through the device. In one embodiment, the end cap assembly 90 further includes a rearward circuit board 76 which cooperates with the forward circuit board 70 to control the operation of the vaporizer 10. See FIG. 1D.

In use, a user removes the mouthpiece 30 from the herb chamber 40. Herbs are then placed within the forward portion of the herb chamber 40 in front of the heating element 100. At this time, a user may select a temperature setting using the temperature adjustment dial 98 and to press the power button 96. The control circuitry then supplies electrical power to the heating element 100. Once the heating element achieves a desired temperature an indicator light (not shown) is illuminated to indicate that the vaporizer is ready for use. At this time, the user may draw air through the opening 36 in the mouthpiece, which draws air through the inlet apertures 22, through the nozzle 50, through the heating element 100 and through herbs within the herb chamber 40. The user receives vapors through the opening 36.

The high temperatures needed to vaporize active ingredients of the herbs within the herb chamber 40 require significant electrical power. Along these lines, the battery 80 requires periodic recharging.

Connection Mechanism

Figure 2A:
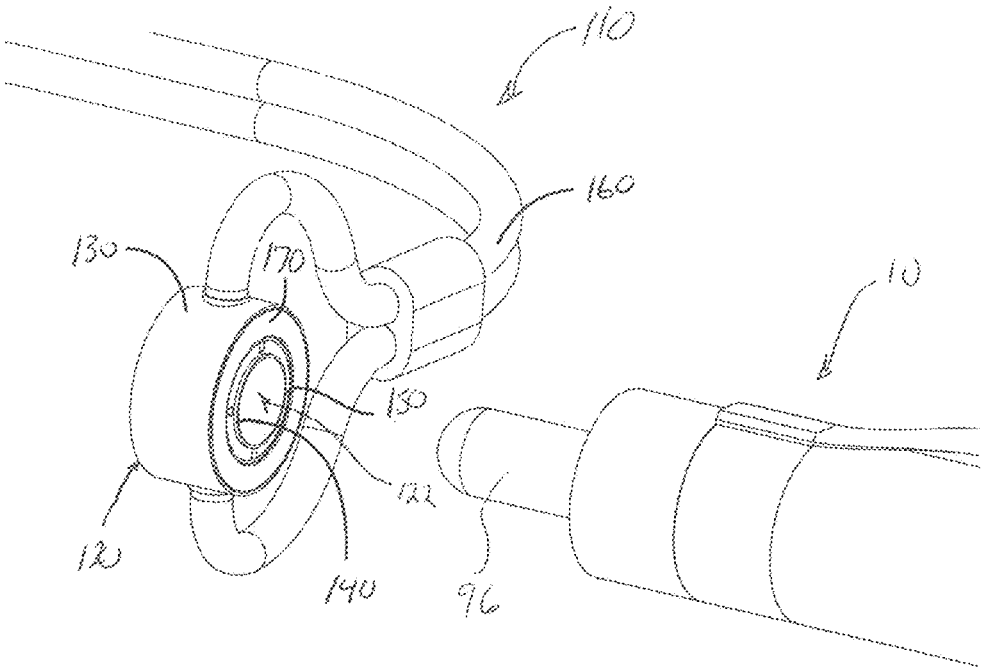
FIG. 2A illustrates an electrical connection mechanism in a detached state.

FIG. 2A shows a perspective view of one embodiment of an electrical connection mechanism 110 in an unconnected state while FIG. 2B shows the connection mechanism in a connected state. Generally, the connection mechanism 110 is an annular sleeve assembly 120 which attaches to the device 10 by means of a magnet. In the current embodiment, the connection mechanism 110 contains a magnet, while the device 10 incorporates a ferromagnetic material/surface to which the magnet adheres. However, reversing the positions of the magnetic and ferromagnetic materials, replacing the ferromagnetic material with a second permanent magnet, or replacing the permanent magnets with electromagnets serve the same purpose and are within the scope of this invention.

In the current embodiment, the sleeve assembly 120 of the mechanism 110 contains two electrically isolated terminals which are, at least partially, concentric. These two terminals electrically contact two mating terminals on the rearward end of the device 10. The sleeve assembly 120 attaches to the device 10 by sliding the inside periphery of an internal aperture 122 around the push button 96 mounted on the rearward end of the device 10. The inside periphery of the aperture 122 provides a clearance-fit around the push button 96 allowing normal operation of the push button 96 while the sleeve assembly 120 is attached to the device 10.

In the illustrated embodiment, the sleeve assembly 120 includes an outer sleeve 130 and an inner sleeve 140. The inner and outer sleeves are substantially concentric and define the electrical terminals of the connection mechanism 110. See also FIG. 2C. The space between the sleeves 120, 130 houses one or more magnets 170 as well as a multi-conductor electrical cable 160, which in the present embodiment extends through the outer sleeve 130 at two locations. Conductors of the cable 160 provide power and/or data connection to the sleeve assembly 120. First and second conductors of the electrical cable 160 electrically connect to the inner and outer sleeves of the sleeve assembly 120. Any means of connection may be utilized.

In the illustrated embodiment, the inner sleeve 140 is formed of first and second annular elements 142*a* and 142*b* (hereafter 142 unless specifically referenced), which are threaded together. As shown, the annular elements 142 are identical except for their orientation. Each of the annular elements 142 has a smooth inside surface that is sized to provide the clearance fit around the push button 96. In contrast, a portion of the outside surface of each annular element is threaded. The threads of two opposing annular elements are received within a threaded annulus 144. Each of the annular elements 142 also include an outer rim 146 having a diameter that is greater than the diameter of the threads.

The inner sleeve 140 is mounted concentrically to and is electrically isolated from the outer sleeve 130 by means of an insulator 150. In the present embodiment, the insulator 150 is formed of first and second annular insulators 150*a*, 150*b*, which are disposed over the outside surface of the outer rims of the annular members 142. In this regard, the annular insulators 150*a*, 150*a* each include a recessed surface that fits over a radially outward portion of the outer rim 146 and over a side portion of the outer rim 146. That is, the annular insulators 150*a*, 150*b* are substantially L-shaped in cross-section. First and second annular magnets 170*a*, 170*b* (hereafter 170 unless specifically referenced) each have a recessed surface that extends over their respective insulator 150. Like the annular insulators, the annular magnets 170 are substantially L-shaped in cross-section. The outer sleeve 130 is a substantially cylindrical member that is sized to receive the outward periphery of the annular magnets 170. As shown, the outer rims of the annular elements 142 are operative to compress and maintain the insulators 150 and magnets 170 together and within the outer sleeve 130 when the opposing annular elements are threaded into the threaded annulus 144. When disposed within the outer sleeve 130, the peripheral end of the sleeve 130 is substantially planar with the magnet 170.

Figure 1D:
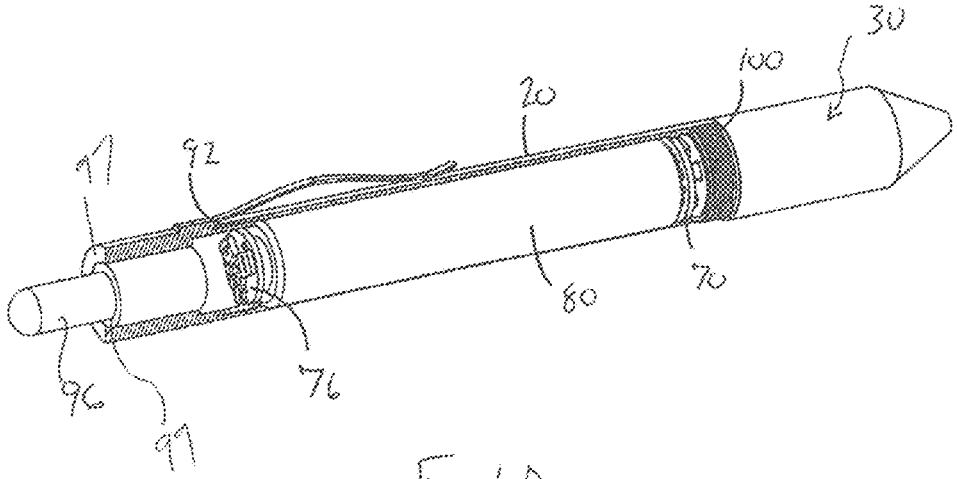
FIG. 1D is cross-sectional perspective view of a rearward portion of the vaporizer of FIG. 1A.
Figure 2C:
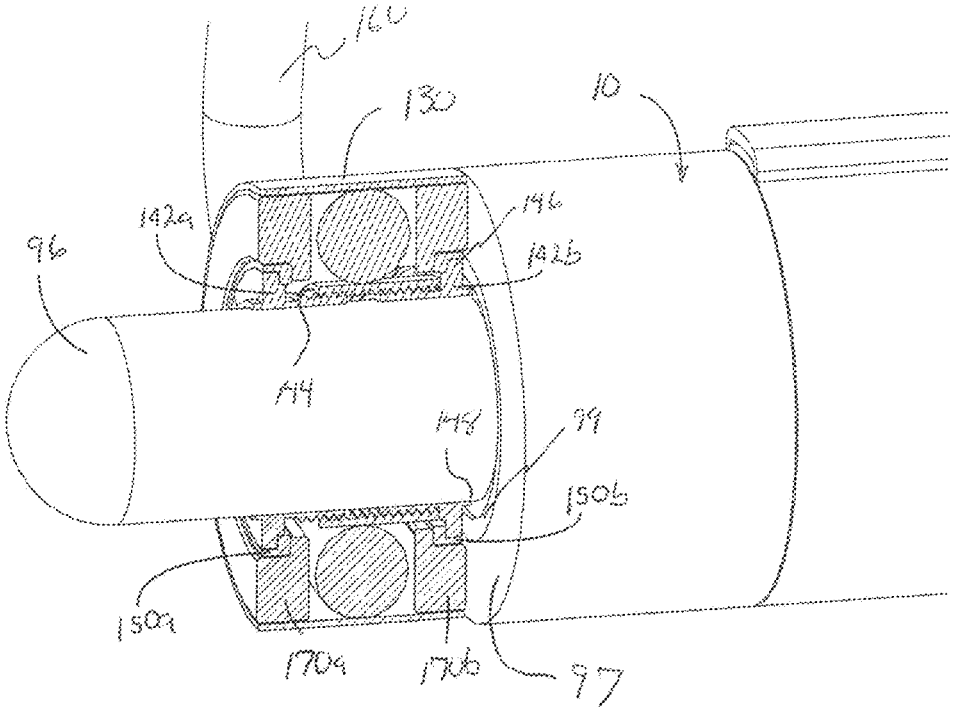
FIG. 2C is a cross-sectional view of the connection mechanism connected to the portable electronic device.

FIGS. 2B and 2C show perspective views of the electrical connection mechanism 110 in a connected state. When the inner sleeve/contact 140 is fit about the push button 96, the magnet 170 magnetically attaches the sleeve assembly 120 to the ferromagnetic end surface 97 of the device 10. This creates two electrical connections between the connector 110 and the device 10. Specifically, the peripheral end surface of the outer sleeve 130 directly contacts the end surface 97 of the device housing to form a first electrical connection. The inner sleeve 140, makes an electrical connection via contact with the push button 96, which is electrically isolated from the end surface 97 via a bushing 99 as best shown in FIG. 1D.

In the present embodiment, the magnetic attachment of the sleeve assembly 120 to the end surface 97 also slightly depresses the push button 98. That is, to provide an electrical connection, the push button must be partially depressed to use the electrical connection mechanism 110 to recharge or power the device 10. To provide such partial depression, the annular member 142 of the inner sleeve 140 includes an annular or partially annular contact 148 that protrudes above (i.e., raised contact) the planar surface of the magnet 170, when the sleeve assembly 120 is assembled. When magnetically attached to the device 10, the raised contact 148 contacts the bushing 99 (which in some embodiments may be a machined step of the push button) on the end of the device and slightly depresses the push button 96, which is spring-loaded. The partial depression of the push button forms the second electrical connection.

In the illustrated embodiment, the sleeve assembly 120 is a two-terminal device where two isolated electrical terminals are the inner and outer sleeves 130, 140. However, through the addition of more concentric insulators and circular conductors of differing diameters, it is straightforward to produce a device with an arbitrary number of terminals.

FIGS. 3A-3D illustrate a further embodiment of the connection mechanism 210 in accordance with various aspects of the presented inventions. As shown, the connection mechanism 210 again includes a sleeve assembly having an outer sleeve 230 and inner sleeve 240, which form first and second electrical connections with a portable electrical device 10. As shown, this embodiment has a number of differences in relation to the previously described embodiment. For instance, the multi-conductor electrical cable 160 enters the outer sleeve 230 at single location.

Figure 3A:
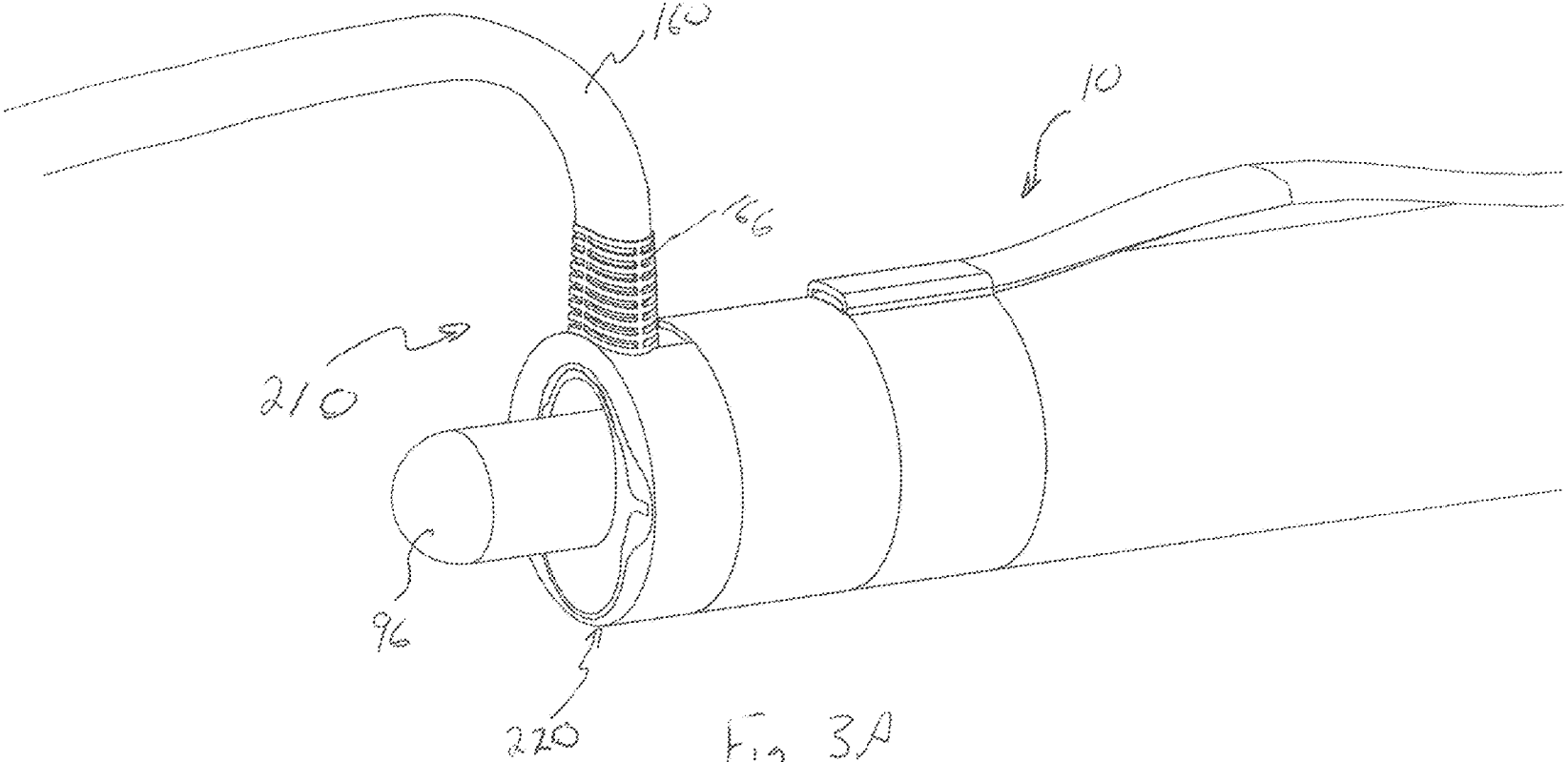
FIG. 3A-3D illustrate another embodiment of a connection mechanism.
Figure 3B:
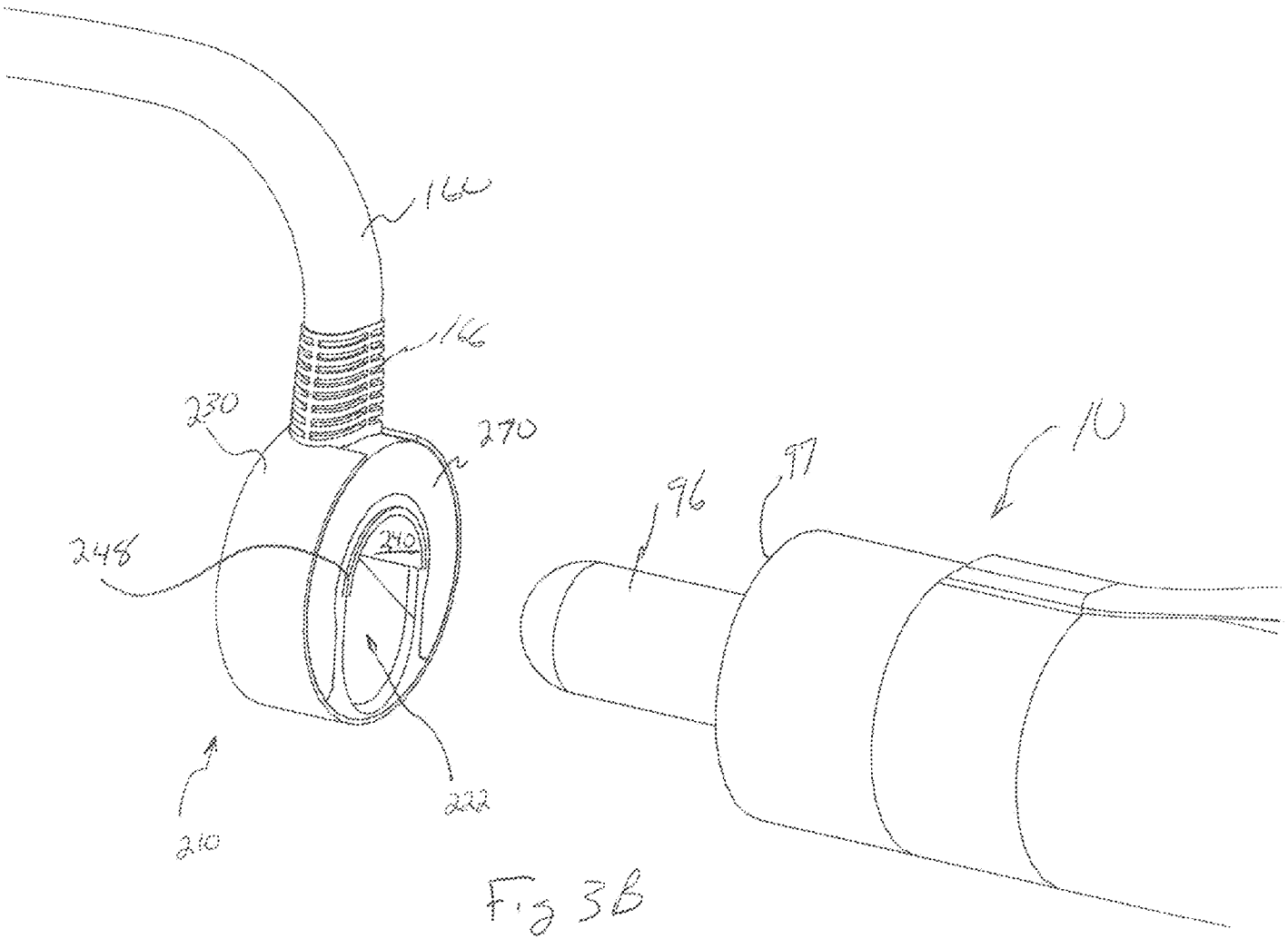
Figure 3C:
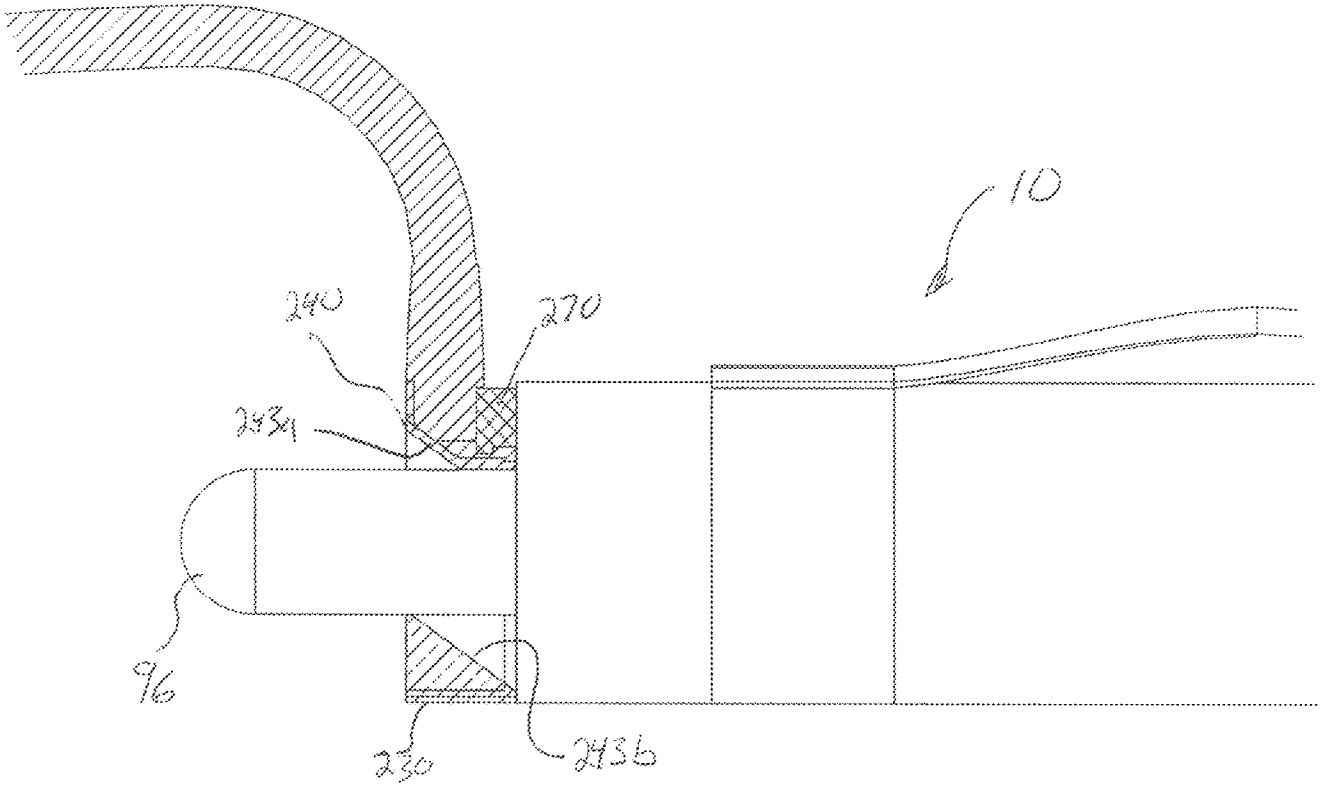
Figure 3D:
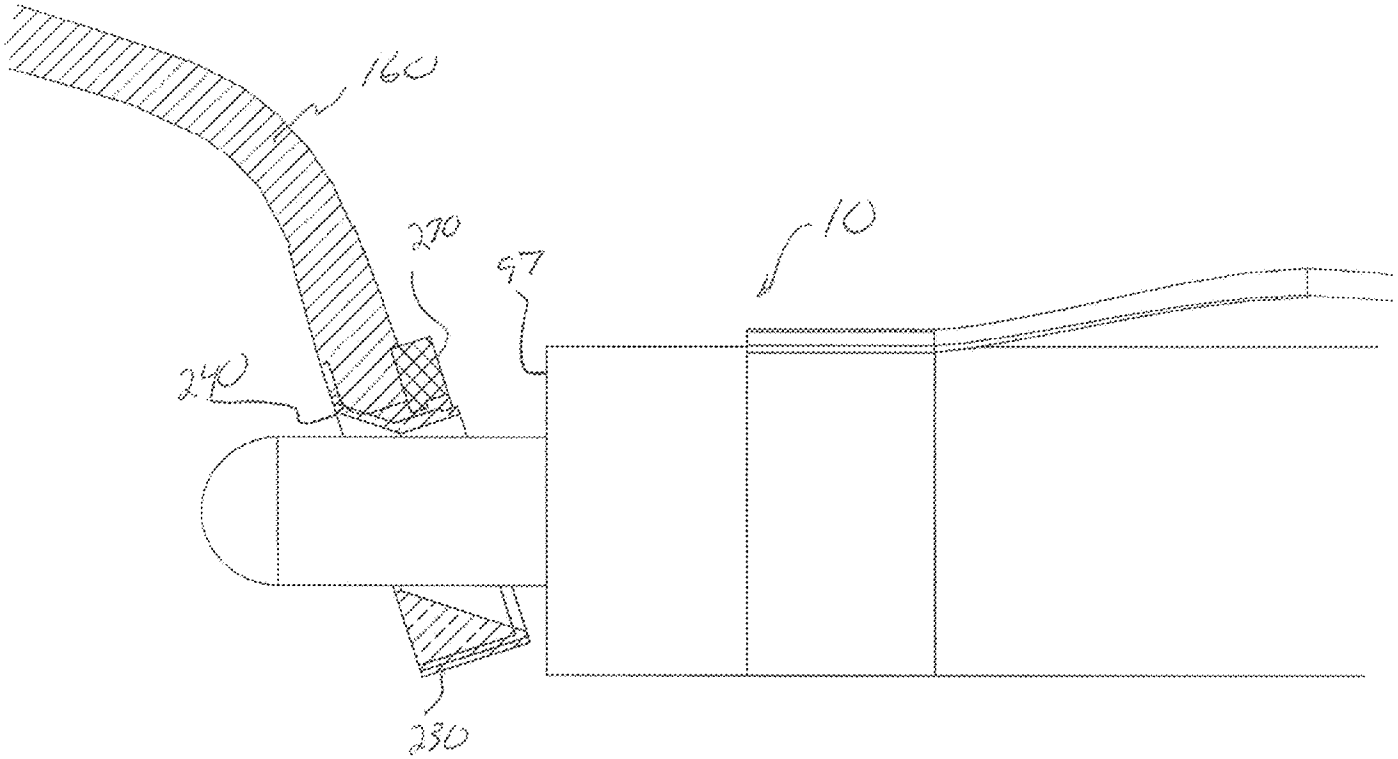

One primary difference between this embodiment and the previous embodiment is that the aperture 222 of the inner sleeve 240 is not circular. Rather, the inner sleeve 140 has an oblong aperture 222 that allows the sleeve assembly 210 to pivot about the push button 96 as the sleeve assembly 210 is removed from the device 10. This is best illustrated in FIGS. 3C and 3D which illustrate the aperture 222 of the inner sleeve 240 as having opposing angled surfaces 243*a* and 243*b*. The inclusion of these angled surfaces prevents binding when removing the sleeve assembly from the device 10. Stated otherwise, the aperture 222 has a centerline axis that is angled (i.e., non-perpendicular) relative to the planar surface of the magnet 270. Stated otherwise, a centerline axis of the aperture 222 is nonaligned with a centerline axis of the push button 96.

As will be appreciated, in the present embodiment, the inner sleeve 240 is not formed of first and second annular members, which thread together. Rather, the inner sleeve 240 may be integrally formed (e.g., milled, cast etc.) or may be formed of separate elements that are, for example, in a press fit engagement. Further, in the illustrated embodiment, a single magnet 270 may be utilized. As shown, the single magnet 270 is generally U-shaped. See FIG. 4C. However, the function of the magnet remains the same. That is, the magnet is adapted to magnetically attach the sleeve assembly 210 to the ferromagnetic end surface 97 of the device 10 in order to make first and second electrical connections.

In the illustrated embodiment, the end surface of the outer sleeve 230 again couples to the ferromagnetic end surface 97 of the device 10 to form the first electrical connection. Likewise, the inner sleeve 240 again utilizes a protruding or raised contact 248, which protrudes above the planar surface of the magnet 270, to make a second electrical connection. When magnetically attached to the device 10, the protruding contact 248 contacts the bushing 99 and slightly depresses the pushbutton 96, which is spring-loaded to form a second electrical connection between the device and the sleeve assembly. As will be appreciated, the embodiment of FIGS. 3A-3D also incorporates various insulators to electrically isolate the outer sleeve from the inner sleeve. Accordingly, these insulators are appropriately shaped to provide isolation of the oblong inner sleeve from the outer sleeve.

Figure 4A:
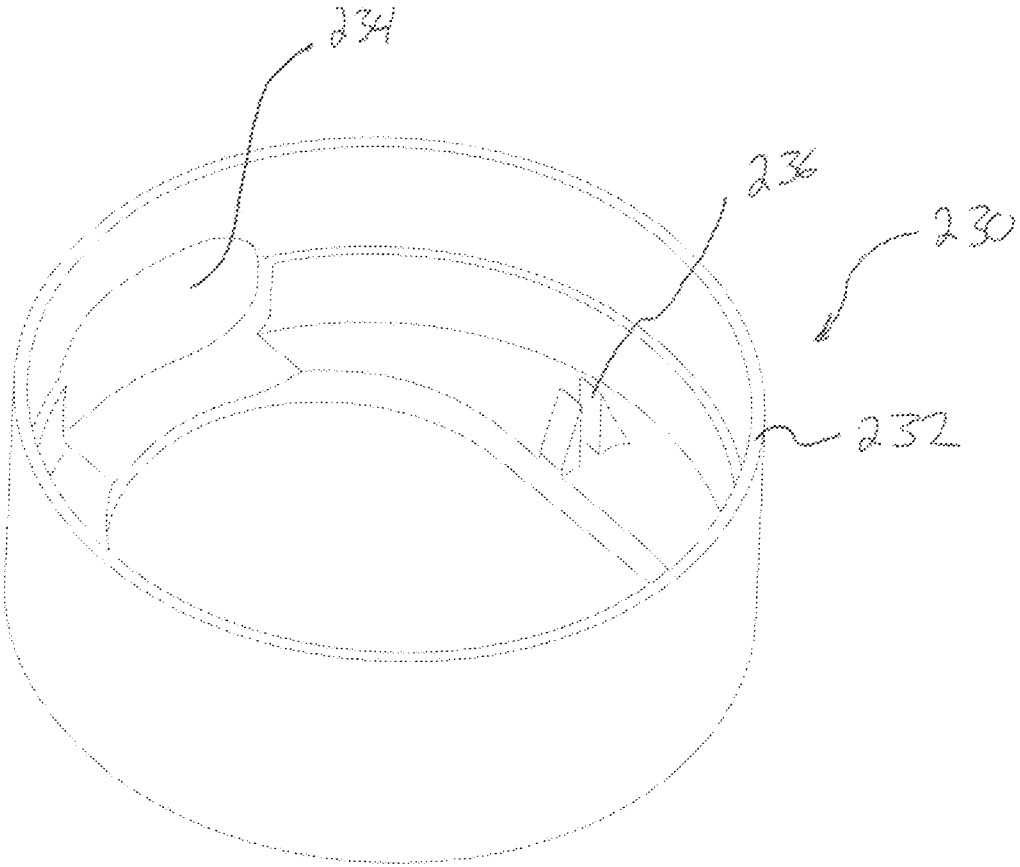
FIGS. 4A-4C illustrate individual components of the connection mechanism of FIGS. 3D-3D.
Figure 4B:
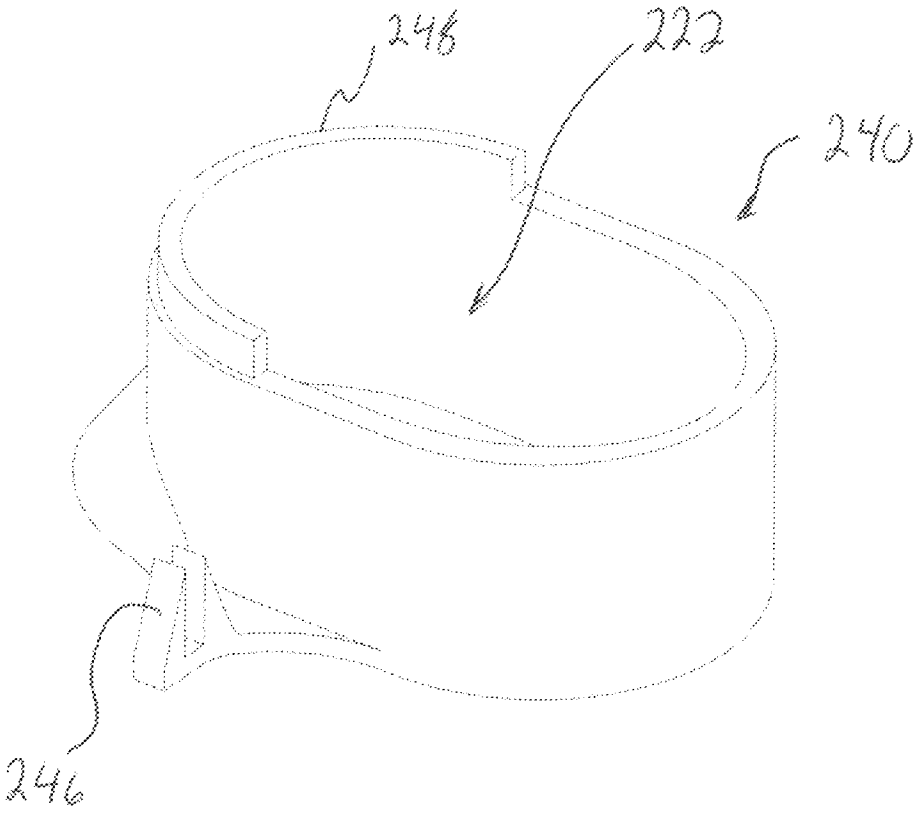
Figure 4C:
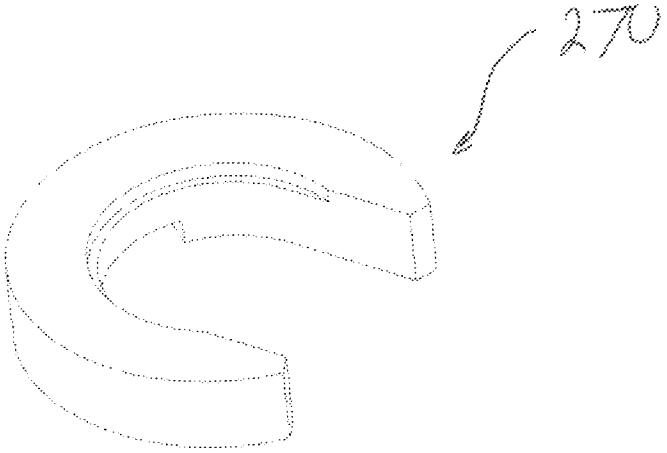

FIGS. 4A, 4B and 4C illustrate individual components of the second embodiment of the connection mechanism 210. Specifically, FIG. 4A illustrates the outer sleeve 230, FIG. 4B illustrates the inner sleeve 240, and FIG. 4C illustrates the magnet 270. As shown in FIG. 4A, the outer sleeve 230 is generally hollow cylindrical element having an end surface 232 that forms an electrical contact with the device 10 when magnetically coupled thereto. A sidewall of the outer sleeve 230 includes a cabling aperture 234 which provides access to the interior of the outer sleeve 230 for the cable 160. Disposed within interior of the generally hollow cylindrical outer sleeve 230 is an electrical connection point 236. In the illustrated embodiment, the electrical connection point 236 is formed as a piercing spike, which allows for creating a compression electrical contact with a conductor of the cable 160. However, it will be appreciated that the electrical connection point may be differently configured for other connection methods including, for example, soldering. In this regard, the piercing spikes may be omitted.

FIG. 4B illustrates the inner sleeve 240 which is sized for disposition within the outer sleeve 230 while being spaced from the outer sleeve to provide electrical isolation. As shown, the inner sleeve 240 includes the above described oblong aperture 222 as well as the protruding or raised contact 248. In addition, the inner sleeve 240 includes a second electrical contact point 246, which is configured for electrical connection with a second conductor of the cable 160.

Figure 5A:
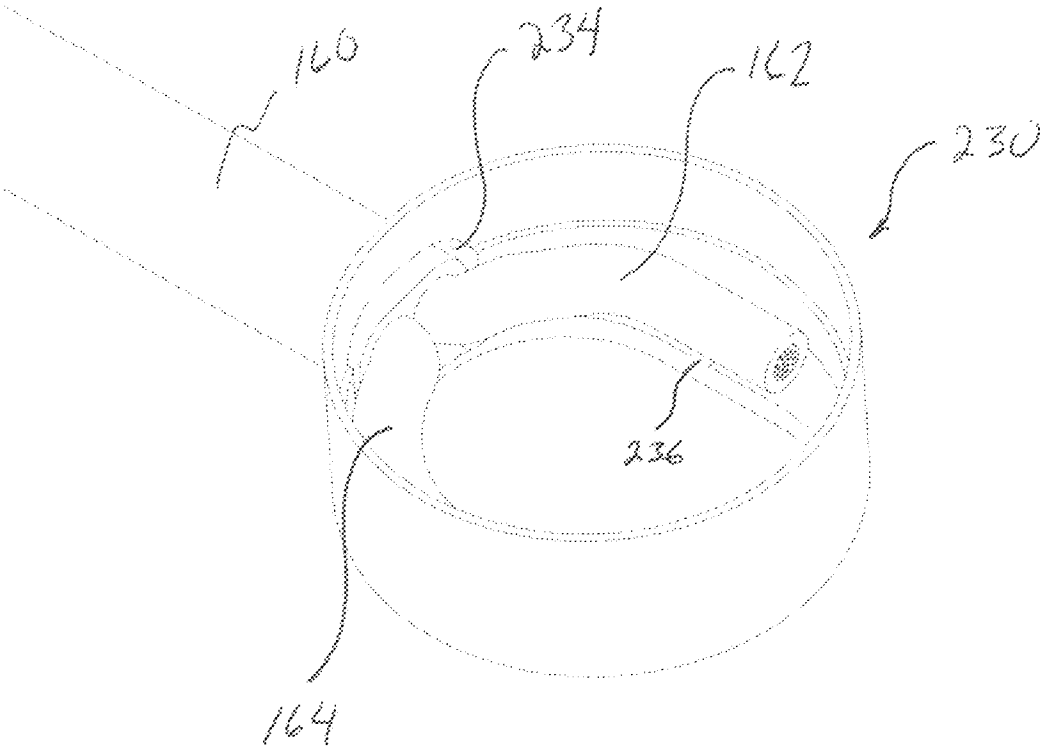
FIG. 5A illustrates an electrical connection of an outer sleeve of the connection mechanism to an electrical conductor.
Figure 5B:
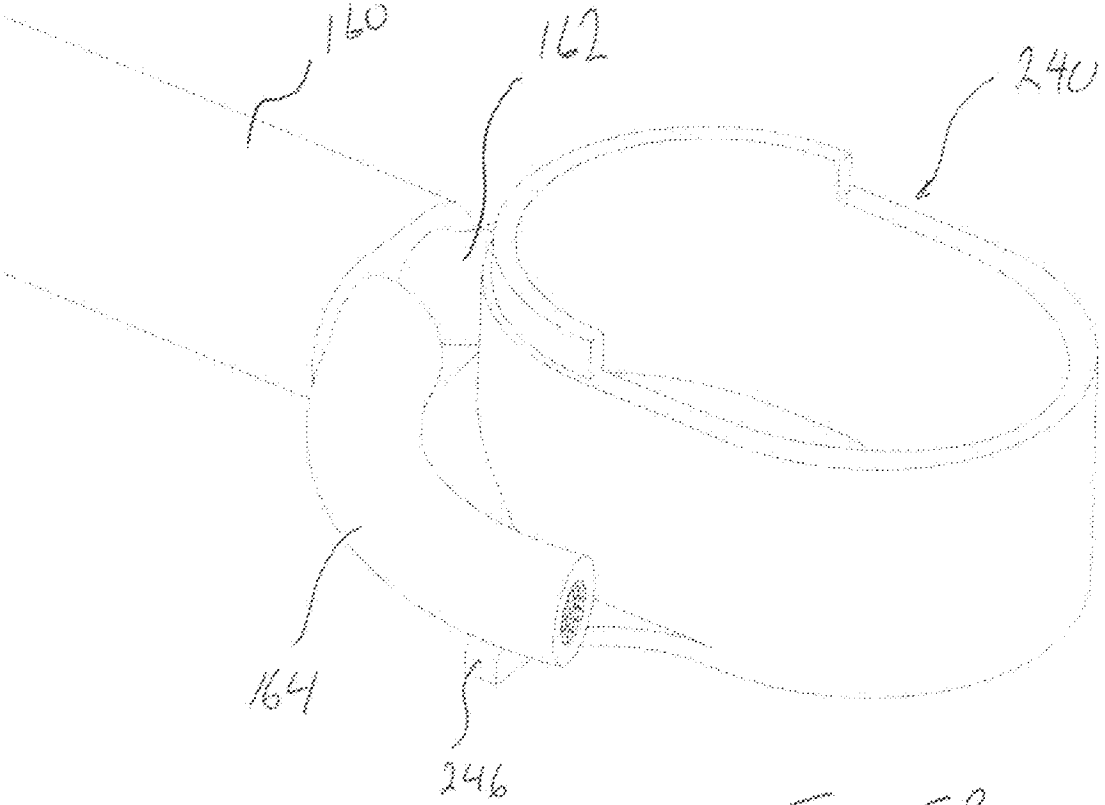
FIG. 5B illustrates an electrical connection of an inner sleeve of the connection mechanism to an electrical conductor.

FIGS. 5A and 5B illustrate the connection of the conductors 162 and 164 of the cable 162 with the connection points 236 and 246 of the inner and outer sleeves, respectively. As shown in FIG. 5A, a portion of the cable 160 extends through the cabling aperture 234 of the outer sleeve 230 such that the first and second conductors 162 and 164 are disposed within the interior of the outer sleeve 230. At such time, the first conductor 162 may be electrically attached to the connection point 236 of the inner sleeve. Likewise, the second conductor 164 may be attached to the connection point 246 of the inner sleeve 240 as shown in FIG. 5B, which shows the inner sleeve removed from the outer sleeve for purposes of illustration.

Figure 6A:
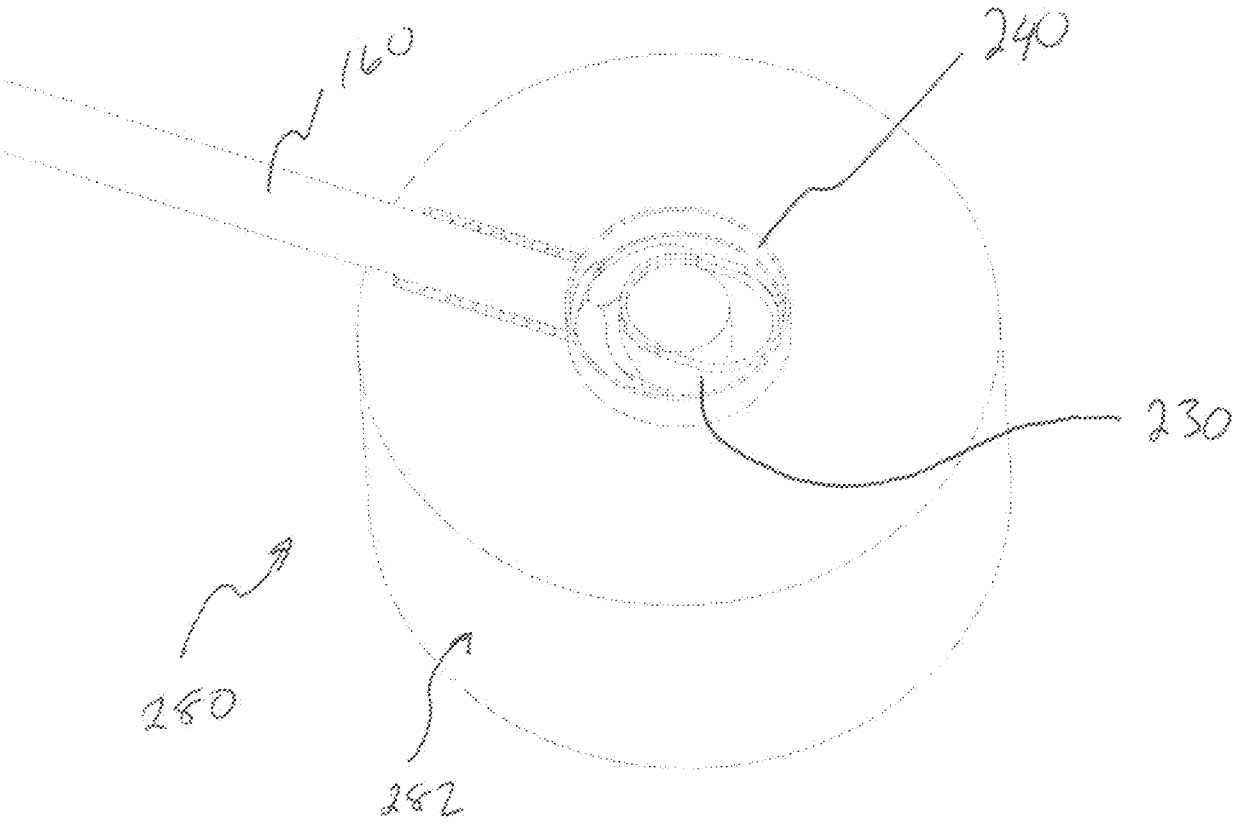
FIGS. 6A-6C illustrates an injection molding process for connecting and electrically isolating components of the connection mechanism.
Figure 6B:
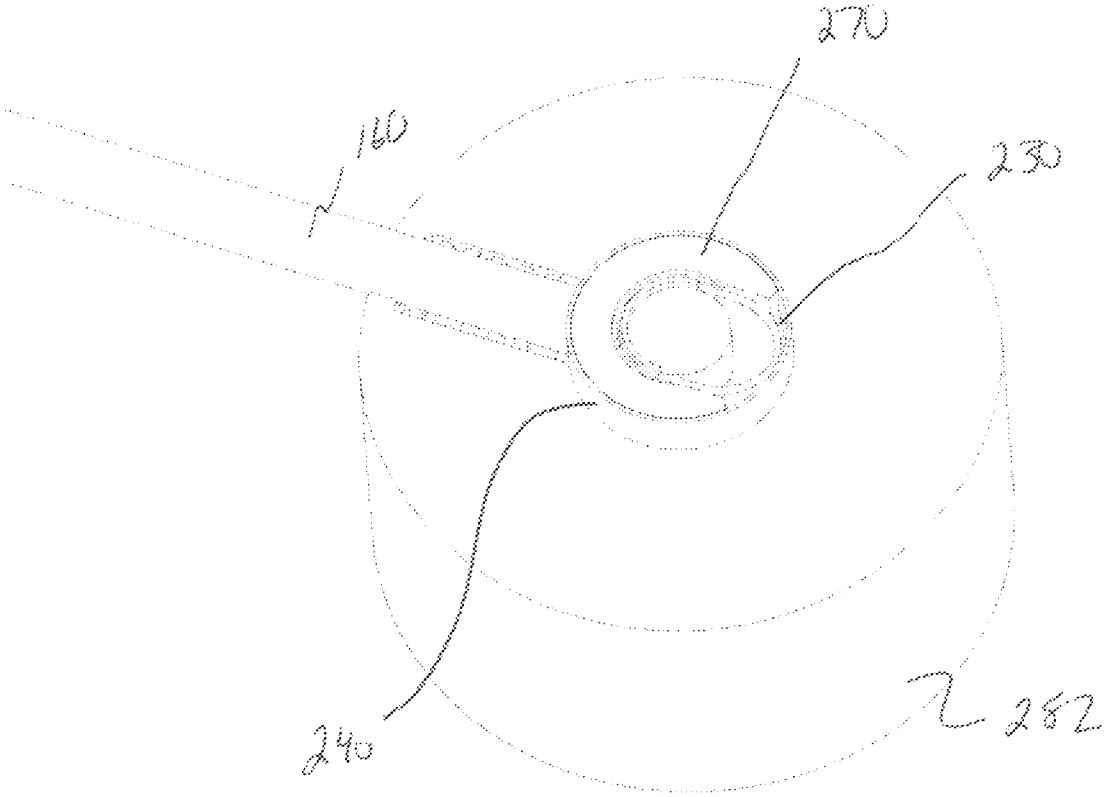

FIGS. 6A and 6B illustrate placement of the outer sleeve 230, inner sleeve 240 and cable 160 within a mold 280 during assembly of the connection mechanism 110. As shown, the inner and outer sleeves 230, 240 are disposed within a lower portion 282 of the mold 280, which is shaped to receive and hold these sleeve members in a predetermined orientation. The cable 160 is then disposed through the cabling aperture 234 of the outer sleeve 230 such that the conductors 162, 164 may be attached to their appropriate connection points. See FIG. 6A. At this time, the magnet 270 is disposed within the sidewall of the outer sleeve 230 and about an outer sidewall of the inner sleeve 240 (See FIG. 6B) such that an upper mold portion 284 may be fit to the lower mold portion 282 encapsulating the sleeves, cable and magnet therein. See FIG. 6C. A resin (e.g., thermoplastic) is then injected into voids within the mold to form an isolator between the inner and outer sleeves 230, 240. In addition, injection of the resin fixedly secures these elements in their final configuration.

Figure 6C:
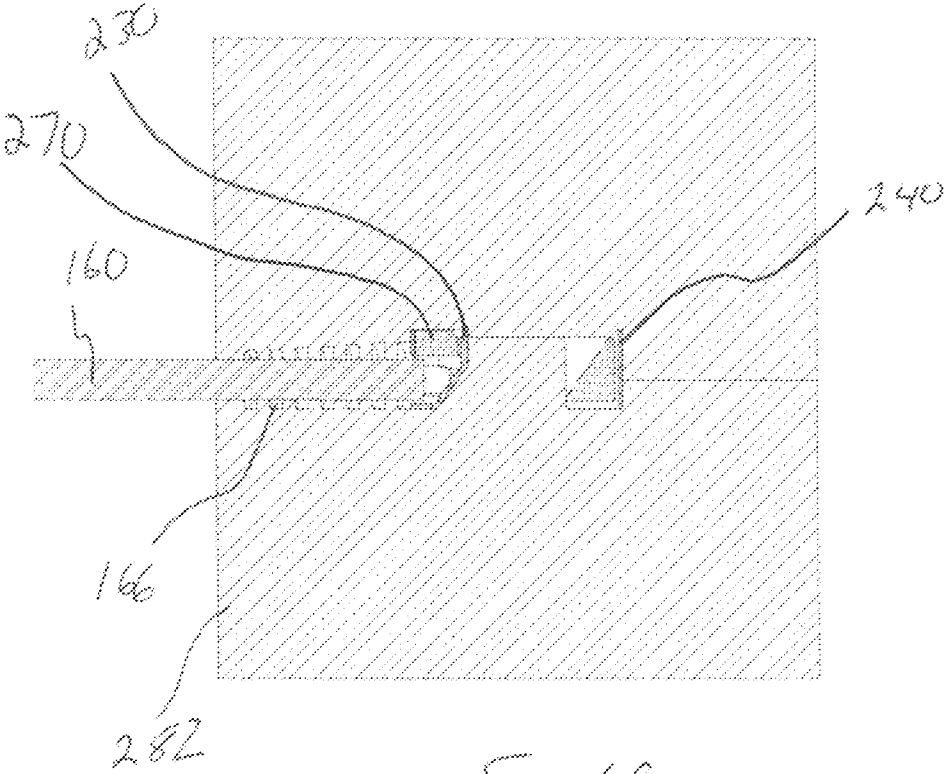

In the embodiment illustrated in FIGS. 6A-6C, upper and lower portions of the mold 280 are also configured to define a strain reliever 166 on an exterior of the cable 160. See also FIGS. 3A and 3B. That is, during the resin injection process, a strain reliever is molded about the cable 160 where it extends from the outer sleeve 240. The inclusion of the strain reliever 166, in conjunction with the oblong aperture 222 significantly reduces the stresses applied to the cable 160 and its connections with the sleeves when the connection assembly 210 is removed from the device. See FIG. 3D. In this regard, a user may remove the assembly 210 by pulling on the cable 160 without concern of physically damaging the connection assembly.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. An herbal vaporizer and external power system, comprising:

an elongated housing including a rechargeable power source;

an herb vaporization chamber attached to a first end of said elongated housing, said herb vaporization chamber including a heating element connectable to said power source;

a depressible push button disposed on a second end of said elongated housing, wherein said push button moves relative to an end surface of said housing and depressing said push button connects said heating element to said power source; and a magnetically attachable and detachable charging assembly including:

an inner conductive sleeve electrically connected to a first conductor of a electric cable, said inner conductive sleeve having an internal aperture sized for conformal disposition about said push button; and an outer conductive sleeve electrically connected to a second conductor of said electric cable; and a magnet disposed at least partially between said inner sleeve and said outer sleeve for holding an end of said outer conductive sleeve against the end surface of said housing, wherein said inner conductive sleeve and said outer conductive sleeve electrically connect said rechargeable power source to said electric cable.

2. The device of claim 1, wherein a surface of said magnet, a peripheral end surface of said outer conductive sleeve and said end surface of said housing are coplanar when said magnet is magnetically attached to said end surface.

3. The device of claim 2, wherein said inner conductive sleeve further comprises:

a protrusion that extends beyond a plane defined by said coplanar elements.

4. The device of claim 3, wherein said protrusion at least partially depresses said push button when said magnet is magnetically attached to said end surface.

5. The device of claim 1, wherein said push button and said end surface are electrically isolated.

6. The device of claim 1, wherein said inner sleeve and said outer sleeve are concentric annular elements.

7. The device of claim 1, wherein said internal aperture comprises:

a centerline axis that is non-aligned with a centerline axis of said push button.

* * * * *